US010378423B1

(12) United States Patent
Reichardt et al.

(10) Patent No.: US 10,378,423 B1
(45) Date of Patent: Aug. 13, 2019

(54) EXHAUST CONDUIT COOLING JACKET AND THERMOSTAT CONFIGURATION FOR OUTBOARD MOTORS

(71) Applicant: Brunswick Corporation, Mettawa, IL (US)

(72) Inventors: Douglas D. Reichardt, West Bend, WI (US); Katelyn A. Vara, Van Dyne, WI (US); Daanish Tyrewala, Houghton, MI (US); Vinodh Kumar Balakrishnan, Fond du Lac, WI (US); Chetan Avinash Dharmadhikari, North Fond du Lac, WI (US); Pankaj Ankush Jagadale, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/889,686

(22) Filed: Feb. 6, 2018

(51) Int. Cl.

| | |
|---|---|
| ***F01P 3/20*** | (2006.01) |
| ***F01P 3/12*** | (2006.01) |
| ***F01P 5/10*** | (2006.01) |
| ***B63H 20/24*** | (2006.01) |
| ***F01N 13/00*** | (2010.01) |
| ***F01P 11/16*** | (2006.01) |

(52) U.S. Cl.
CPC ..... *F01P 3/202* (2013.01); *B63H 20/245* (2013.01); *F01N 13/004* (2013.01); *F01P 3/12* (2013.01); *F01P 5/10* (2013.01); *F01P 11/16* (2013.01); *B63B 2758/00* (2013.01); *F01P 2025/32* (2013.01)

(58) Field of Classification Search
CPC .... F01P 3/202; F01P 11/16; F01P 5/10; F01P 3/12; F01P 2025/32; F01N 13/004; B63H 20/245; B63B 2758/00
See application file for complete search history.

(56) References Cited

U.S. PATENT DOCUMENTS

| | | | | |
|---|---|---|---|---|
| 5,803,036 | A * | 9/1998 | Takahashi | F01M 1/02 123/179.25 |
| 5,820,426 | A | 10/1998 | Hale | |
| 5,873,330 | A * | 2/1999 | Takahashi | F01N 3/043 123/195 P |
| 6,120,335 | A | 9/2000 | Nakase et al. | |
| 6,226,984 | B1 | 5/2001 | Ford | |
| 6,461,208 | B2 | 10/2002 | Suzuki et al. | |
| 7,001,231 | B1 | 2/2006 | Halley et al. | |
| 7,625,257 | B1 | 12/2009 | Broman et al. | |
| 7,942,138 | B1 | 5/2011 | Belter | |

(Continued)

*Primary Examiner* — Anthony D Wiest
(74) *Attorney, Agent, or Firm* — Andrus Intellectual Property Law, LLP

(57) ABSTRACT

An exhaust manifold is for an outboard motor having an internal combustion engine. The exhaust manifold has an exhaust conduit that conveys exhaust gas from the internal combustion, and a cooling jacket on the exhaust conduit. The cooling jacket defines a first cooling water passage that conveys cooling water in a first direction alongside the exhaust conduit, a second cooling water passage that conveys the cooling water from the first cooling water passage in an opposite, second direction alongside the exhaust conduit, and third cooling water passage that is separate from the first and second cooling water passages and conveys spent cooling water from the internal combustion engine to a thermostat.

21 Claims, 7 Drawing Sheets

(56) References Cited

U.S. PATENT DOCUMENTS

| | | | |
|---|---|---|---|
| 8,500,501 | B1 | 8/2013 | Taylor et al. |
| 8,540,536 | B1 | 9/2013 | Eichinger et al. |
| 8,763,566 | B1 | 7/2014 | Taylor et al. |
| 9,365,274 | B1 | 6/2016 | George et al. |
| 9,365,275 | B1 | 6/2016 | Habeck et al. |
| 9,534,526 | B1 | 1/2017 | Eichinger et al. |
| 9,616,987 | B1 | 4/2017 | Langenfeld et al. |

* cited by examiner

EXHAUST CONDUIT COOLING JACKET AND THERMOSTAT CONFIGURATION FOR OUTBOARD MOTORS

FIELD

The present disclosure relates to outboard motors, and more particularly to exhaust conduit cooling jacket and thermostat configurations for outboard motors.

BACKGROUND

The following U.S. Patents are incorporated herein by reference in entirety:

U.S. Pat. No. 5,820,426 discloses an exhaust system for a personal watercraft having an exhaust adapter plate and an exhaust header pipe that allows exhaust to exit from the rear of a horizontally-mounted internal combustion engine.

U.S. Pat. No. 9,534,526 discloses an elongated exhaust conduit comprising a first end receiving hot exhaust gas from a marine engine and a second end discharging the exhaust gas. An elongated cooling water jacket extends adjacent to the exhaust conduit. The cooling water jacket conveys the raw cooling water adjacent to the exhaust conduit to thereby cool the exhaust conduit and warm the raw cooling water therein and discharges the warmed cooling water to cool the marine engine. The cooling water jacket comprises first and second channels that are separate from each other. The cooling water is oriented in a helical flow around the exhaust conduit.

U.S. Pat. No. 9,616,987 discloses a marine engine including a cylinder block having first and second banks of cylinders that are disposed along a longitudinal axis and extend transversely with respect to each other in a V-shape so as to define a valley there between. A catalyst receptacle is disposed at least partially in the valley and contains at least one catalyst that treats exhaust gas from the marine engine. A conduit conveys the exhaust gas from the marine engine to the catalyst receptacle. The conduit receives the exhaust gas from the first and second banks of cylinders and conveys the exhaust gas to the catalyst receptacle. The conduit reverses direction only once with respect to the longitudinal axis.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An exhaust manifold is for an outboard motor having an internal combustion engine. The exhaust manifold comprises an exhaust conduit that conveys exhaust gas from the internal combustion. A cooling jacket is disposed on the exhaust conduit. The cooling jacket defines a first cooling water passage that conveys cooling water in a first direction alongside the exhaust conduit, a second cooling water passage that conveys the cooling water from the first cooling water passage in an opposite, second direction alongside the exhaust conduit, and third cooling water passage that is separate from the first and second cooling water passages and conveys spent cooling water from the internal combustion engine to a thermostat.

In certain examples, the first cooling water passage has an inlet that receives the cooling water from a cooling water pump, the second cooling water passage has an outlet that discharges the cooling water from the cooling jacket, and the third cooling water passage has an inlet that receives the spent cooling water from the internal combustion engine. The thermostat is mounted on the exhaust manifold and is movable into and between a closed position and an open position in which the spent cooling water is discharged from the third cooling water passage. A radial wall separates the third cooling water passage from the first and second cooling water passages. A bleed hole is formed through the radial wall, the bleed hole facilitating passage of air from the first and second cooling water passages to the third cooling water passage for discharge via the thermostat.

DETAILED DESCRIPTION OF THE DRAWINGS

Figure 1:
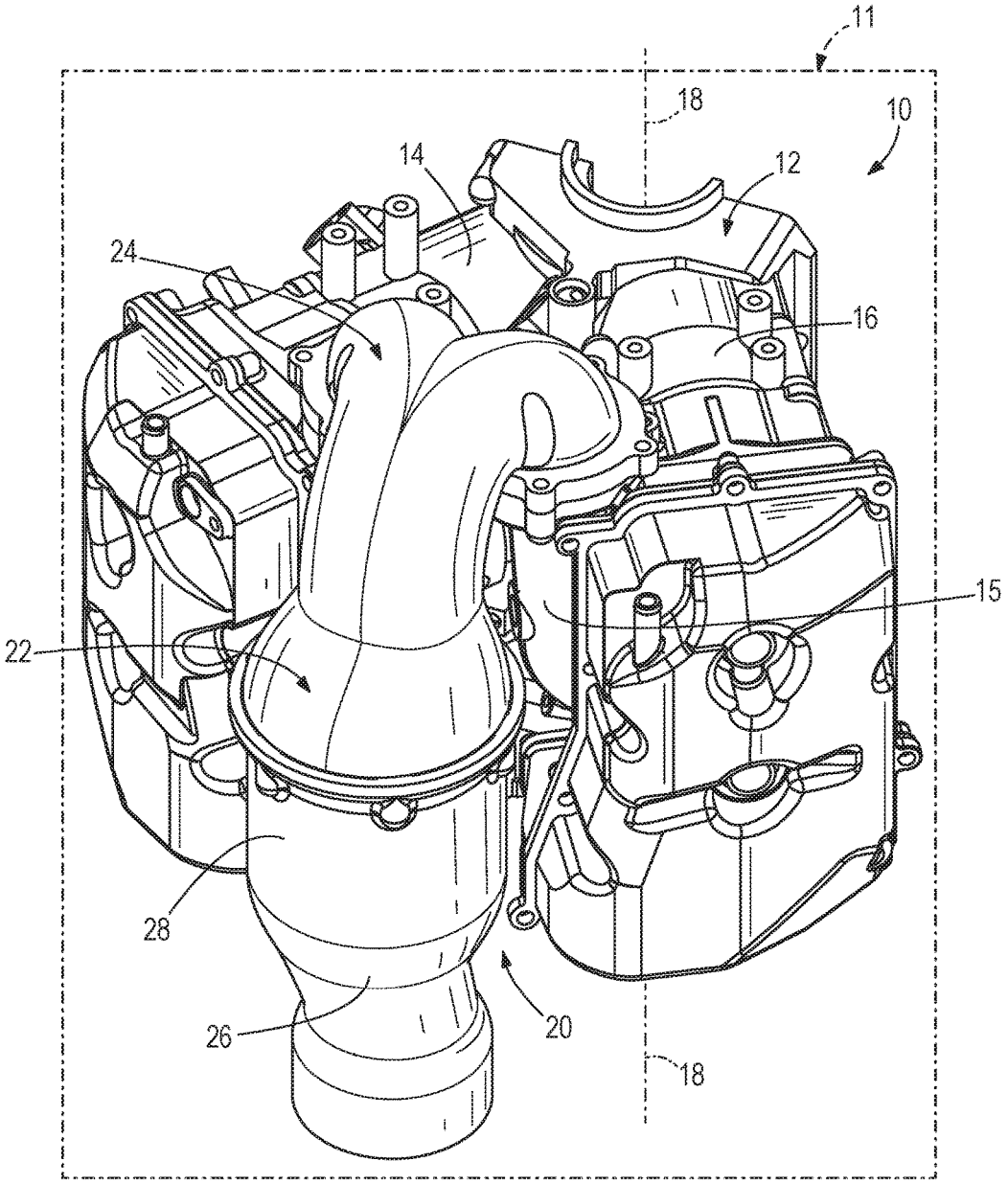
FIG. 1 PRIOR ART
FIG. 1 is a perspective view of an internal combustion engine for marine propulsion device having an exhaust manifold.

FIG. 1 is taken from U.S. Pat. No. 9,616,987 and depicts an internal combustion engine 10 configured for use in an outboard motor 11. The internal combustion engine 10 has a cylinder block 12 with first and second banks of cylinders 14, 16 that are disposed along a vertical axis 18 and extend transversely with respect to each other in a V-shape so as to define a valley 20 there between. It should be recognized however that FIG. 1 is merely exemplary and that the configuration of the outboard motor 11 can vary from what is shown. The concepts of the present disclosure can be implemented with internal combustion engines having a different number and/or configuration/alignment of cylinders.

An exhaust manifold 22 is configured to convey exhaust gas from the internal combustion engine 10. The exact configuration of the exhaust manifold 22 can also vary from what is shown. In the illustrated example, the exhaust manifold 22 is disposed in the valley 20 and initially conveys the exhaust gas vertically upwardly from cast-in exhaust conduits 15 (only one is shown) on the respective banks of cylinders 14, 16, through a 180-degree bend 24, and then vertically downwardly through an elongated conduit 26, which optionally can include a catalyst receptacle 28 having a catalyst therein for treating the exhaust gas, all as disclosed in the '987 patent.

Figure 2:
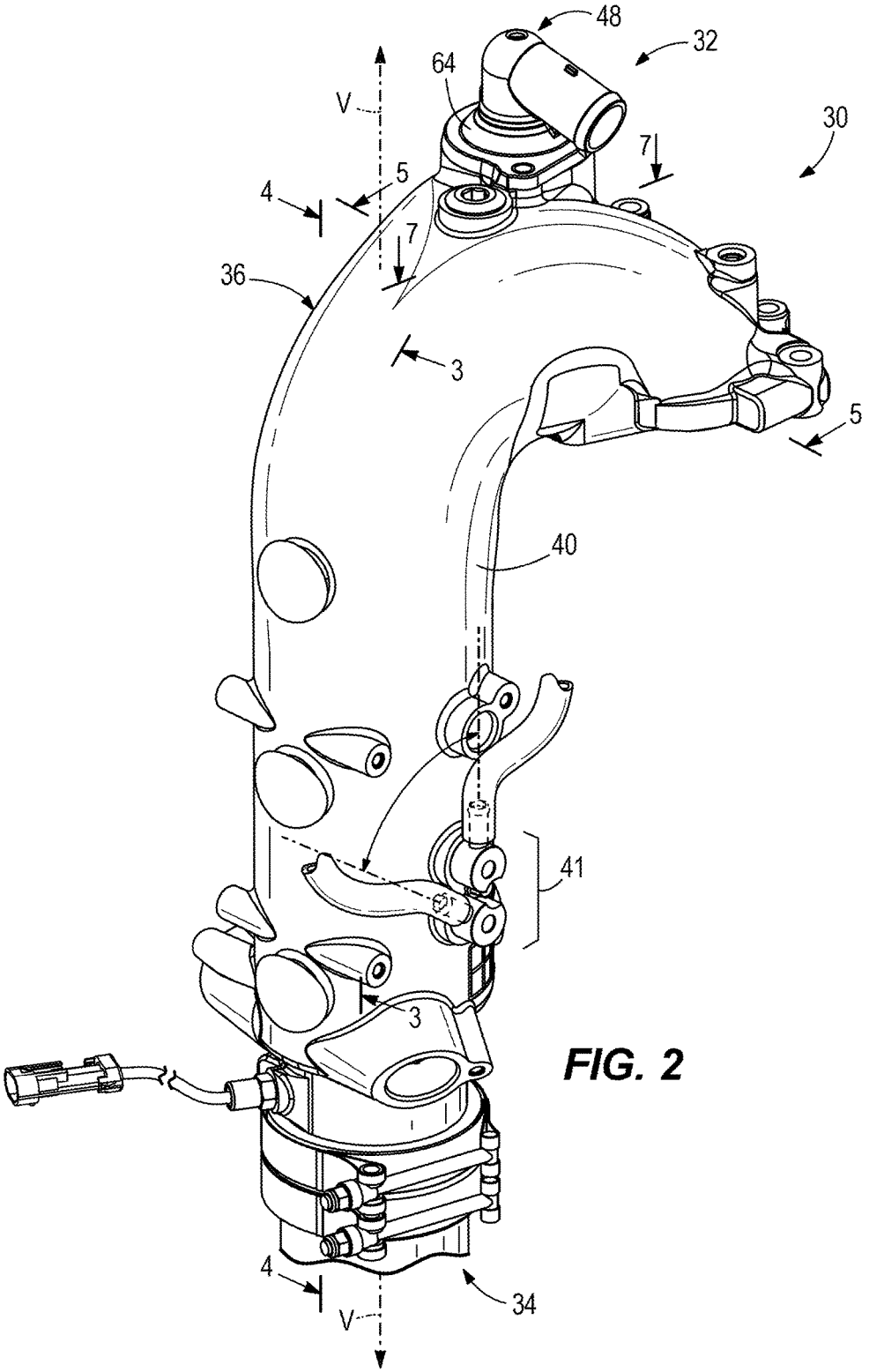
FIG. 2 is a perspective view of an exhaust manifold according to the present disclosure.
Figure 3:
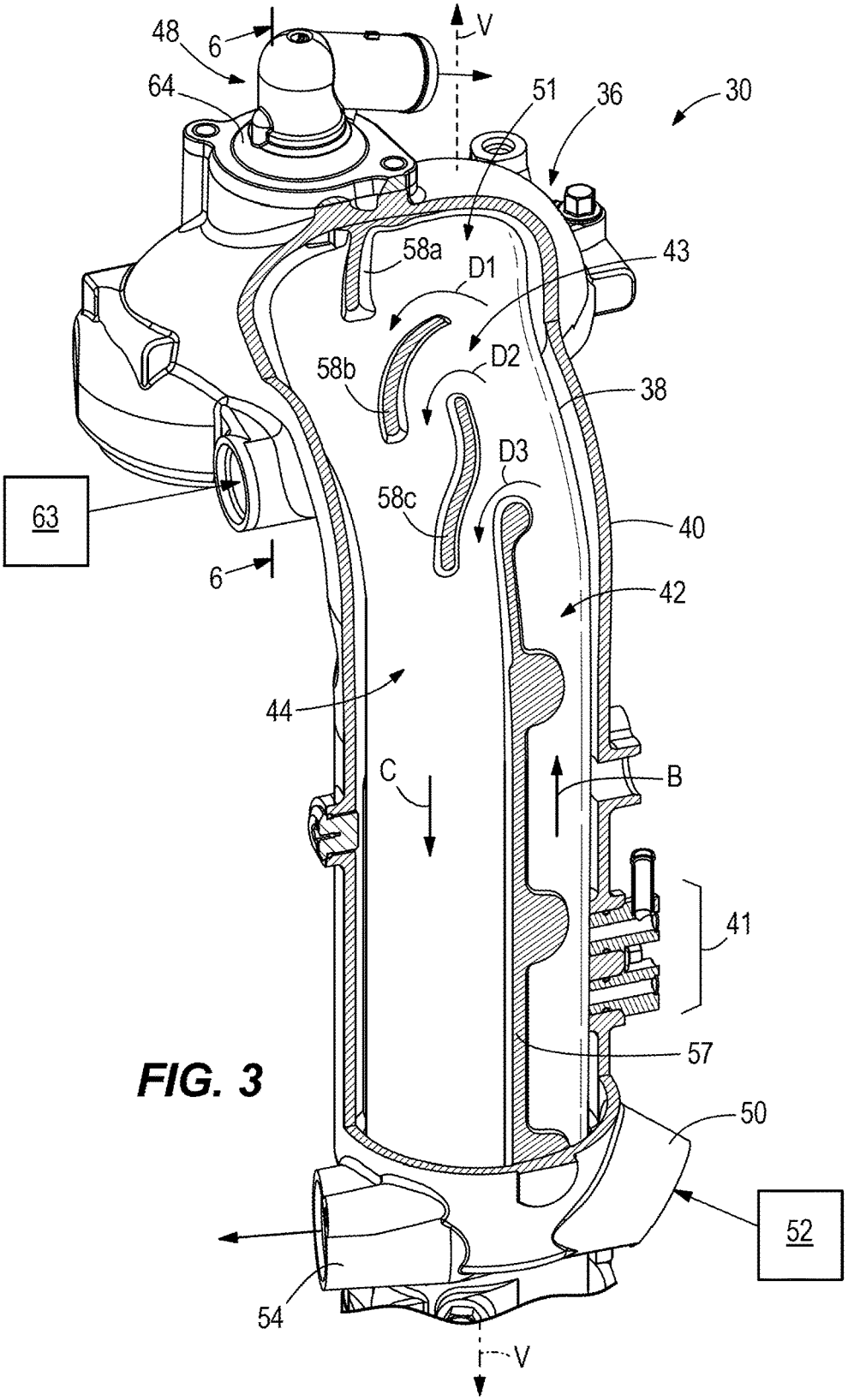
FIG. 3 is a view showing a portion of the cooling jacket removed from the exhaust manifold.
Figure 4:
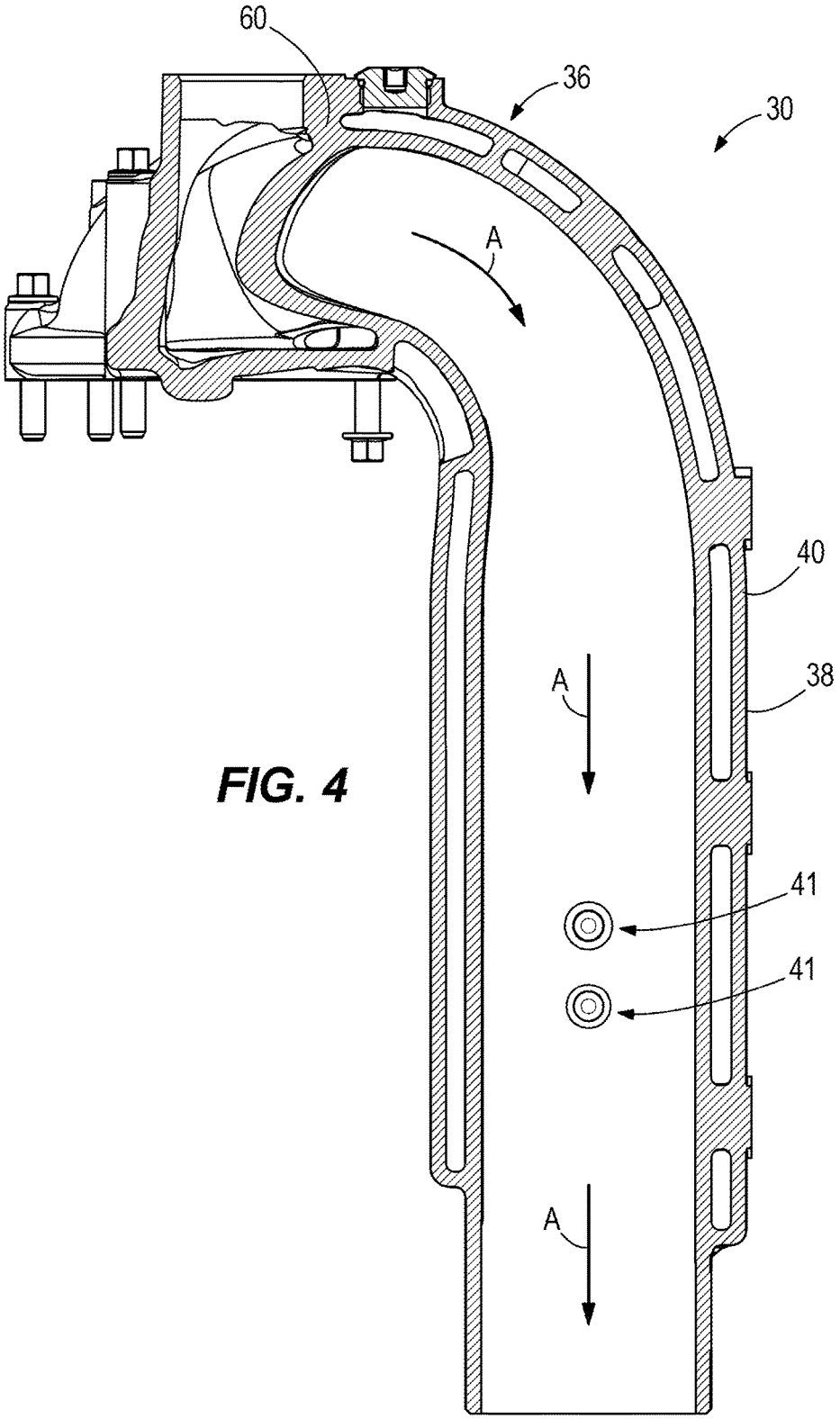
FIG. 4 is a vertical section view of the exhaust manifold.

Referring now to FIGS. 2-7, an exhaust manifold 30 is configured according to the concepts of the present disclosure. The exhaust manifold 30 extends from top 32 to bottom 34 along a vertical axis V. Similar to the example in FIG. 1, the exhaust manifold 30 is configured to convey exhaust gas from the internal combustion engine 10, first vertically upwardly from the internal combustion engine 10, then through a 180 degree bend 36, and then vertically downwardly away from the internal combustion engine 10. Referring to FIG. 4, the exhaust manifold 30 has an elongated exhaust conduit 38 that conveys the exhaust gas away from the internal combustion engine 10, as shown by arrows A. The exhaust manifold 30 also has a cooling jacket 40 disposed on the exhaust conduit 38. In the illustrated example, the cooling jacket 40 radially surrounds and extends alongside of a majority of the exhaust conduit 38. The extent to which the cooling jacket 40 extends on the exhaust conduit 38 can vary. Other examples are provided in the above-incorporated U.S. Pat. No. 9,534,526.

During research and experimentation, the present inventors have determined that it is desirable to reduce the weight and size of the outboard motor 11. It is also desirable to design components of the outboard motor 11 in a manner that efficiently utilizes a limited available design space. The present inventors have further determined that air pockets can occur in the cooling jacket 40 on the exhaust manifold 30, particularly in embodiments wherein cooling water is pumped vertically upwardly and then returned back downwardly in the cooling jacket 40. These air pockets can interfere with the flow of the cooling water through the cooling jacket 40 and potentially result in local hotspots due to vapor formation on the internal combustion engine 11, which is undesirable.

The presently described exhaust manifold configurations are a result of the inventors endeavors to overcome the above-described challenges.

During research and experimentation, the present inventors realized that it would be possible to incorporate a thermostat and associated return passage for spent (warm) cooling water from the internal combustion engine 10 into the exhaust manifold 30 of the outboard motor 11, and particularly into the cooling jacket of the exhaust manifold 30. This unique combination represents a significant improvement over the prior art in that it provides an efficient and very effective use of design space. Also, through research and experimentation, the present inventors realized that including turning vanes in the cooling jacket 40 is an effective way to achieve a smooth, even flow of cooling water through its transition from upward flow to downward flow, thus minimizing formation of air pockets. With the above combination of improvements, the inventors further realized that it would be beneficial to add a small bleed hole that connects the passages for the spent (warm) cooling water to the passages for the incoming (cold) cooling water, thus allowing for an efficient removal of the air pockets via a thermostat that controls discharge of the spent cooling water. However the inventors realized that the bleed hole and surrounding cooling jacket structure should be specially configured to prevent the cooling water from entering the bleed hole and/or preventing passage of air there through. These and other improvements and advantages are further described and claimed herein below.

Referring in particular to FIG. 3, the cooling jacket 40 defines a first cooling water passage 42 that conveys cooling water in a first direction shown at arrows B alongside the exhaust conduit 38. In the illustrated example, the first direction is generally vertically upwardly alongside the exhaust conduit 38. The cooling jacket 40 also defines a second cooling water passage 44 that conveys the cooling water from the first cooling water passage 42 in an opposite, second direction shown at arrows C alongside the exhaust conduit 38. In the illustrated example, the first cooling water passage 42 is on a radially opposite side of the exhaust conduit 38 with respect to the second cooling water passage 44. As shown in FIG. 2, the first cooling water passage 42 has an inlet 50 that receives the cooling water from an associated cooling water pump 52, which is a conventional item that pumps the cooling water in a conventional way from the surrounding body of water in which the outboard motor 11 is operating. The cooling water pump 52 can for example be a conventional mechanical pump or electric pump. The second cooling water passage 44 has an outlet 54 that discharges the cooling water from the cooling jacket 40, for example to other components of the outboard motor 11, e.g., the internal combustion engine 10 or the lower gearcase for discharge from the outboard motor 11.

Referring to FIG. 3, the cooling jacket 40 further includes a transition passage 43 that connects the first and second cooling water passages 42, 44 and transitions the cooling water from the first direction B to the second direction C, in this case from the upward flow to the downward flow. In this example, the first cooling water passage 42 and the second cooling water passage 44 generally extend along the vertical axis V and the transition passage generally extends transversely to the vertical axis V. The inlet 50 on the first cooling water passage 42 and the outlet 54 on the second cooling water passage 44 are located below the transition passage 43 with respect to the vertical axis V.

As will be understood by one having ordinary skill in the art, as the cooling water travels along the passages 42, 43, 44 the relatively cold cooling water exchanges heat with the relatively hot exhaust gases flowing through the exhaust conduit 38, thus cooling the exhaust gases prior to discharge from the outboard motor 11. As further described in co-pending U.S. patent application Ser. Nos. 15/729,747 and 15/729,760, cooling water sprayers 41 optionally can be incorporated into the exhaust manifold 30 and configured to spray cooling water into the flow of exhaust gas, thereby cooling it.

An axially-elongated dividing wall 57 radially extends into the cooling jacket 40 and separates the first and second cooling water passages 42, 44. The dividing wall 57 has a series of curvatures along its length, including at its upper end, which facilitates smooth flow, for example around the transition passage 43. A series of turning vanes 58*a*, 58*b*, 58*c* radially extends into the transition passage 43 above the dividing wall 57 and divide the cooling water flowing through the transition passage 43 into separate flows, as shown at arrows D1, D2 and D3. Each of the turning vanes 58*a*-58*c* includes a curvature or is curved in a manner and orientation that facilitates an even, smooth transition of the cooling water from the first direction A to the second direction B, thus reducing pressure drop and formation of air pockets. The turning vanes 58*a*-58*c* advantageously reduce flow separation in the cooling jacket 40 and facilitate filling of the cooling jacket 40 with cooling water. The configuration and number of turning vanes can vary from what is shown. The turning vane 58*a* will be further described herein below. The turning vane 58*b* has a downwardly curved shape, that generally forms a backwards letter C. The turning vane 58*c* has a serpentine shape that generally forms a backwards letter S. The turning vanes 58*b*, 58*c* prevent the cooling water from stagnating in the upper corner 51 of the transition passage 43 by providing a path for it to flow to the second cooling water passage 44. These features surprisingly resulted in a reduced restriction (pressure drop) in the cooling water as it flows through the cooling jacket 40.

Figure 5:
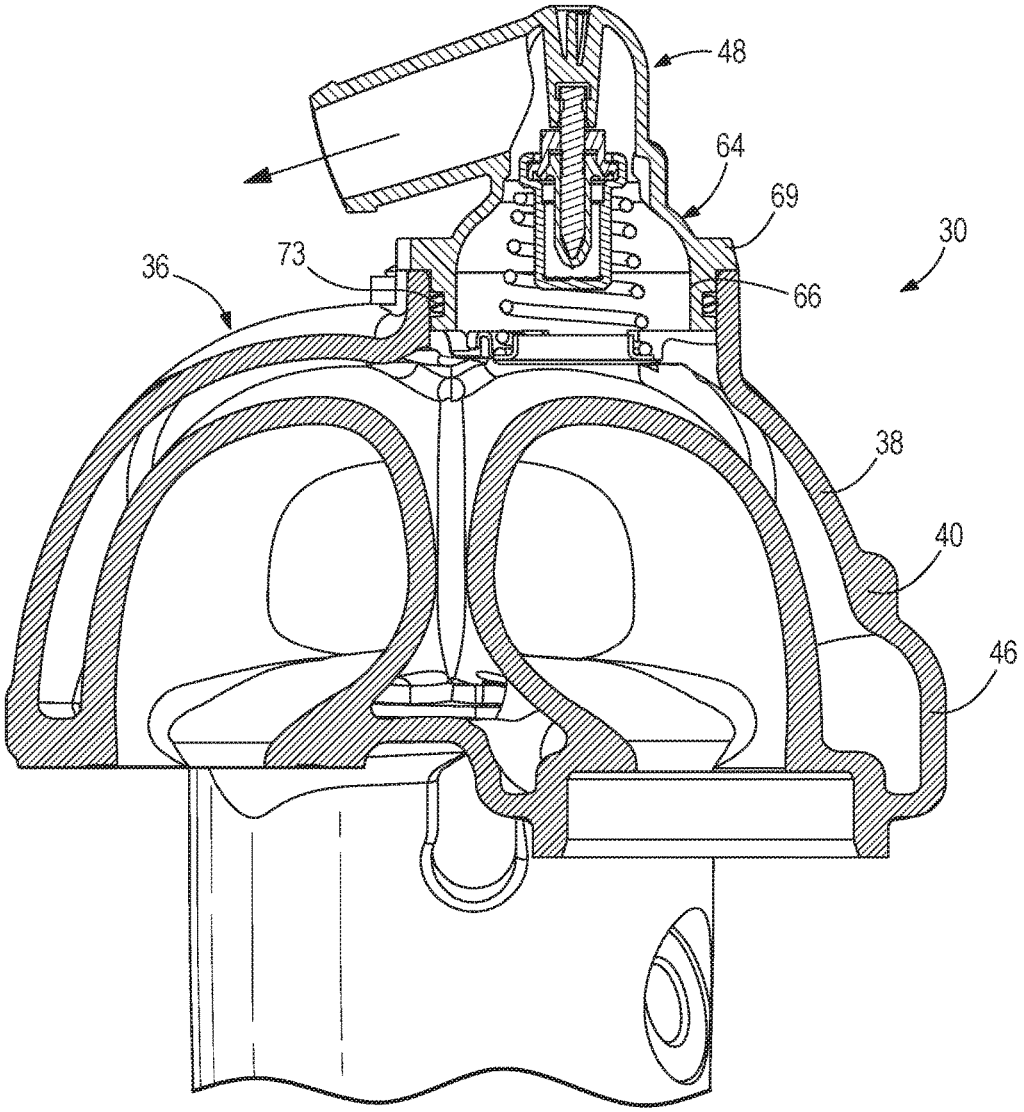
FIG. 5 is a vertical section view through a 180 degree bend of the exhaust manifold.
Figure 6:
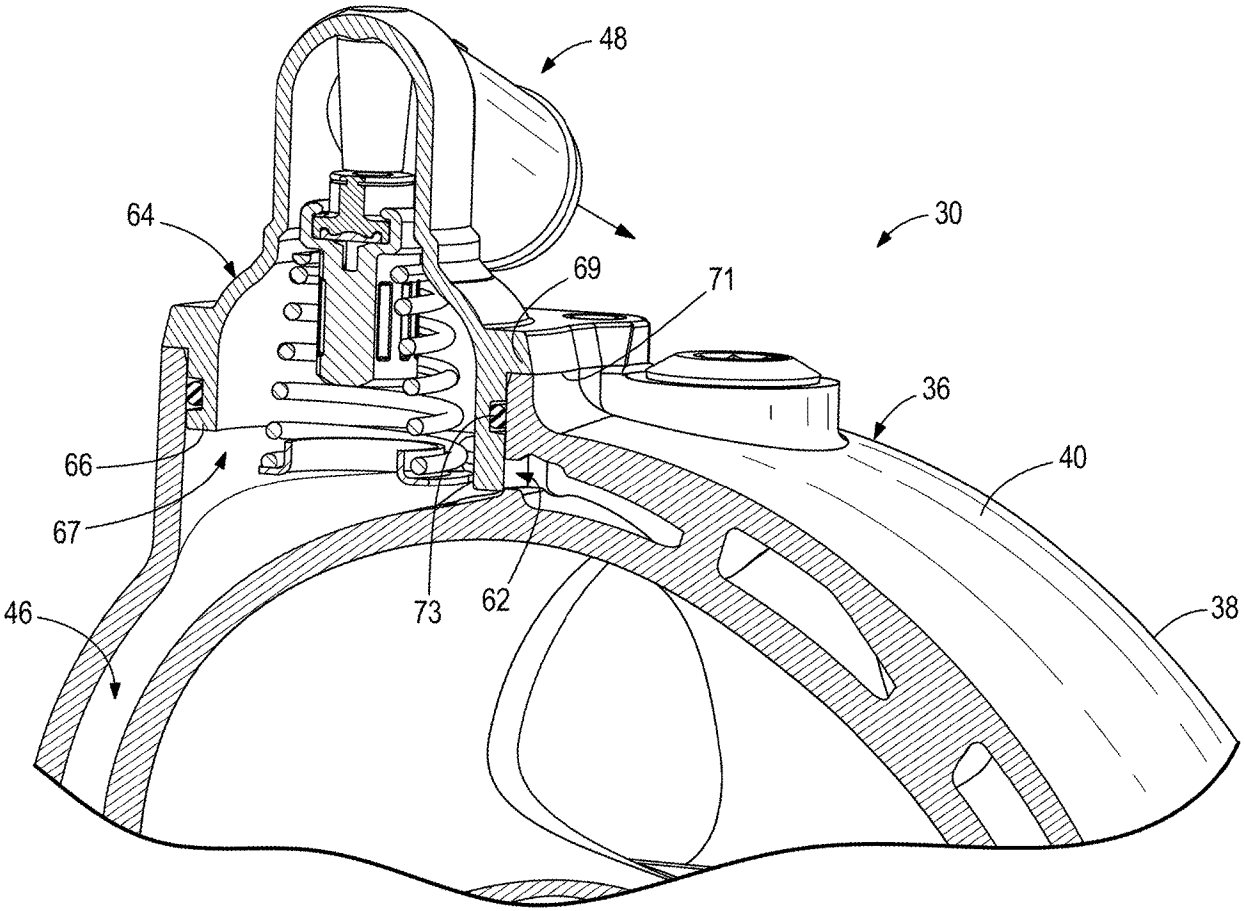
FIG. 6 is a vertical section view that is generally transverse to the view shown in FIG. 5.
Figure 7:
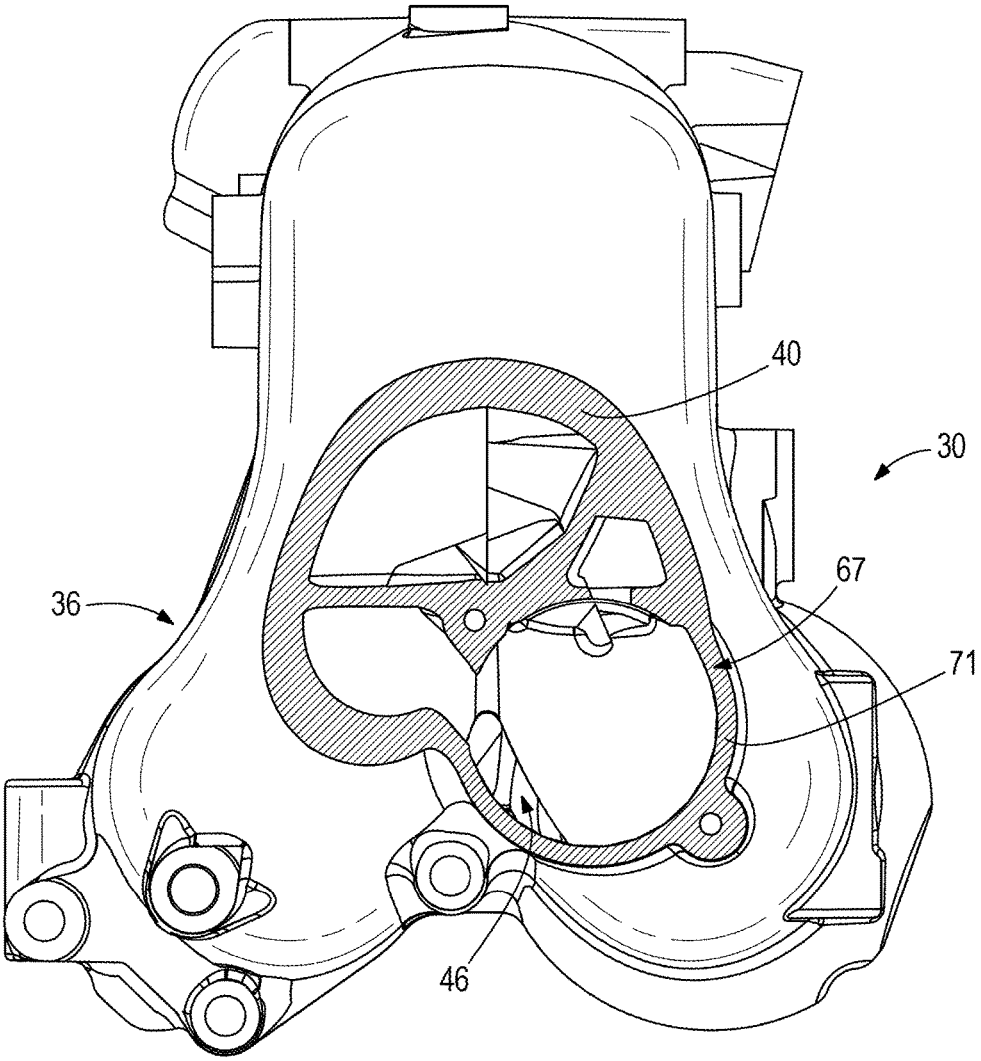
FIG. 7 is a horizontal section taken through a top portion of the exhaust manifold, below the thermostat.

Referring now to FIGS. 5 and 6, the cooling jacket 40 also has a third cooling water passage 46 that is separated from the first and second cooling water passages 42, 44 by a radial wall 60. The third cooling water passage 46 is configured to convey spent cooling water from the internal combustion engine 10, for example from cooling passages in the head of the engine 10, to a thermostat 48, for discharge from the outboard motor 11. The spent cooling water can be pumped into the third cooling water passage 46 via a conventional cooling water pump 63 (see FIG. 3) located either upstream or downstream of the internal combustion engine 10. The cooling water pump 63 can for example be a conventional mechanical pump or electric pump. The third cooling water passage 46 is generally located on the opposite side of the 180 degree bend 36 with respect to the first and second cooling water passages 42, 44; however the location and configuration of the third cooling water passage 46 can vary from what is shown and described.

The thermostat 48 is uniquely mounted on top of the exhaust manifold 30 above the transition passage 43 with respect to the vertical axis V. The thermostat 48 can be a conventional item. Thermostats 48 are well known in the art, and are movable into and between a closed position that prevents flow of spent cooling water through the thermostat 48, and an open position in which the spent cooling water is discharged from the third cooling water passage 46. Normally the thermostat 48 automatically moves between the open and closed positions based upon the temperature of the cooling water. The thermostat 48 is not further described herein in detail because in general, use of thermostats to discharge spent cooling water from an internal combustion engine of an outboard motor is well known in the art, examples being provided in U.S. Pat. Nos. 8,500,501; 8,763,566; and 9,365,274; which are incorporated herein by reference.

Referring to FIG. 4, a radial wall 60 separates the third cooling water passage 46 from the first and second cooling water passages 42, 44. Referring to FIG. 6, bleed hole 62 is formed through the radial wall 60 and facilitates passage of air from the first and second cooling water passages 42, 44, and specifically from the transition passage 43, to the third cooling water passage 46 for discharge via the thermostat 48. The thermostat 48 has a housing 64 with a lower end 66 that protrudes into the third cooling water passage 46 when the thermostat 48 is installed into a mounting hole 67 (see FIG. 8) in the exhaust manifold 30. The lower end 66 of the thermostat housing 64 has a diameter that is slightly smaller than the diameter of the mounting hole 67 such that the lower end 66 snugly fits into the mounting hole 67. A supporting ledge 69 that extends radially outwardly from the lower end 66 rest on an upper mounting surface 71 that extends around the mounting hole 67. An O-ring seal 73 is seated in a radial recess in the lower end 66 and seals in a water-tight relationship with a radially inner perimeter wall of the mounting hole 67. As can be seen in FIG. 6, the lower end 66 of the thermostat housing 64 overlaps the bleed hole 62 and thus forms a baffle with respect to air and/or water that enters the bleed hole 62 from the transition passage 43. Thus, the lower end 66 of the thermostat housing 64 and bleed hole 62 function together to effectively meter the flow of air and/or water from the transition passage 43 to the third cooling water passage 46, and more particularly to meter and/or prevent the flow of cooling water from the transition passage 43 to the third cooling water passage 46. Now turning to FIG. 3, the turning vane 58*a* curves from the radial wall 60 into the transition passage 43 from an upstream side of the radial wall 60 over or in front of the bleed hole 62 with respect to the flow of cooling water through the transition passage 43, thereby forms a shield that further limits flow of cooling water to the bleed hole 62 and limits formation of debris by the bleed hole 62, as shown by arrow D1.

The present disclosure thus provides a cooling system for a marine engine having the exhaust conduit 38, cooling jacket 40 and thermostat 48. A pump 63 pumps the spent cooling water through the internal combustion engine 10 and into the third cooling water passage 46 of the cooling jacket 40. Another cooling water pump 52 pumps another flow of cooling water into the first cooling water passage 42 and alongside the exhaust conduit 38 for cooling the exhaust therein.

The present disclosure advantageously solves the problems noted above, and particularly provides an improved exhaust manifold configuration that effectively utilizes available design space within the outboard motor and effectively and efficiently manages cooling water flow and formation of air pockets within the cooling jacket.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

The invention claimed is:

1. An exhaust manifold for an outboard motor having an internal combustion engine, the exhaust manifold comprising:

an exhaust conduit that conveys exhaust gas from the internal combustion;

a cooling jacket on the exhaust conduit, the cooling jacket defining a first cooling water passage that conveys cooling water in a first direction alongside the exhaust conduit, a second cooling water passage that conveys the cooling water from the first cooling water passage in an opposite, second direction alongside the exhaust conduit, and third cooling water passage that conveys spent cooling water from the internal combustion engine to a thermostat;

wherein the first cooling water passage has an inlet that receives the cooling water from a cooling water pump, wherein the second cooling water passage has an outlet that discharges the cooling water from the cooling jacket, and wherein the third cooling water passage has an inlet that receives the spent cooling water from the internal combustion engine;

wherein the thermostat is mounted on the exhaust manifold and is movable into and between a closed position and an open position in which the spent cooling water is discharged from the third cooling water passage; and a radial wall that separates the third cooling water passage from the first and second cooling water passages.

2. The exhaust manifold according to claim 1, wherein a bleed hole is formed through the radial wall, the bleed hole facilitating passage of air from the first and second cooling water passages to the third cooling water passage for discharge via the thermostat.

3. The exhaust manifold according to claim 2, further comprising a baffle that overlaps the bleed hole and limits flow of cooling water from the first and second cooling water passages to the third cooling water passage via the bleed hole.

4. The exhaust manifold according to claim 3, wherein thermostat comprises a housing having a lower end, and wherein the lower end of the housing extends into the third cooling water passage and forms the baffle that overlaps the bleed hole.

5. The exhaust manifold according to claim 1, further comprising transition passage that connects the first and second cooling water passages and transitions the cooling water from the first direction to the second direction.

6. The exhaust manifold according to claim 4, further comprising a dividing wall that radially extends into the cooling jacket and extends along and between the first and second cooling water passages.

7. The exhaust manifold according to claim 4, further comprising a radial wall that separates the third cooling water passage from the first and second cooling water passages, wherein a bleed hole is formed through the radial wall, the bleed hole facilitating passage of air from the first and second cooling water passages to the third cooling water passage for discharge via the thermostat, and wherein the at least one turning vane extends into the transition passage on an upstream side of the radial wall, thereby limiting flow of cooling water from the transition passage to the bleed hole.

8. An exhaust manifold for an outboard motor having an internal combustion engine, the exhaust manifold comprising:

an exhaust conduit that conveys exhaust gas from the internal combustion;

a cooling jacket on the exhaust conduit, the cooling jacket defining a first cooling water passage that conveys cooling water in a first direction alongside the exhaust conduit, a second cooling water passage that conveys the cooling water from the first cooling water passage in an opposite, second direction alongside the exhaust conduit, and third cooling water passage that conveys spent cooling water from the internal combustion engine to a thermostat;

wherein the first cooling water passage has an inlet that receives the cooling water from a cooling water pump, wherein the second cooling water passage has an outlet that discharges the cooling water from the cooling jacket, and wherein the third cooling water passage has an inlet that receives the spent cooling water from the internal combustion engine;

a transition passage that connects the first and second cooling water passages and transitions the cooling water from the first direction to the second direction; and at least one turning vane that radially extends into the transition passage and divides the cooling water into separate flows through the transition passage.

9. The exhaust manifold according to claim 8, wherein the at least one turning vane is one of a plurality of turning vanes that are spaced apart along the transition passage.

10. The exhaust manifold according to claim 8, wherein the at least one turning vane is curved so as to facilitate a smooth transition of the cooling water from the first direction to the second direction.

11. An exhaust manifold for an outboard motor having an internal combustion engine, the exhaust manifold comprising:

an exhaust conduit that conveys exhaust gas from the internal combustion; and a cooling jacket on the exhaust conduit, the cooling jacket defining a first cooling water passage that conveys cooling water in a first direction alongside the exhaust conduit, a second cooling water passage that conveys the cooling water from the first cooling water passage in an opposite, second direction alongside the exhaust conduit, and third cooling water passage that conveys spent cooling water from the internal combustion engine to a thermostat;

wherein the first cooling water passage has an inlet that receives the cooling water from a cooling water pump, wherein the second cooling water passage has an outlet that discharges the cooling water from the cooling jacket, and wherein the third cooling water passage has an inlet that receives the spent cooling water from the internal combustion engine;

a transition passage that connects the first and second cooling water passages and transitions the cooling water from the first direction to the second direction; and wherein the exhaust manifold extends along a vertical axis and wherein the first cooling water passage and second cooling water passage extend along the vertical axis, and wherein the transition passage extends transversely to the vertical axis.

12. The exhaust manifold according to claim 11, wherein the inlet of the first cooling water passage and the outlet of the second cooling water passage are located below the transition passage with respect to the vertical axis, and wherein the thermostat is mounted on the exhaust manifold above the transition passage with respect to the vertical axis.

13. An outboard motor comprising:

an internal combustion engine;

an exhaust manifold that conveys exhaust gas from the internal combustion engine;

a cooling jacket on the exhaust conduit and configured to receive spent cooling water from the internal combustion engine; and a thermostat mounted on the exhaust manifold and configured to discharge spent cooling water from the cooling jacket;

wherein the internal combustion engine comprises a cylinder block and wherein the exhaust manifold is mounted on the cylinder block.

14. The outboard motor according to claim 13, wherein the cylinder block comprises a plurality of cylinders and a cast-in exhaust conduit that conveys the exhaust gas from the plurality of cylinders, and wherein the exhaust manifold has first end that receives the exhaust gas from the cast-in exhaust conduit and a second end that discharges the exhaust gas.

15. The outboard motor according to claim 13, wherein the exhaust manifold has first end that receives the exhaust gas from engine block and a second end that discharges the exhaust gas, and wherein the exhaust manifold comprises a 180-degree bend that conveys the exhaust gas in a first direction from the first end and then in an opposite direction towards the second end.

16. The outboard motor according to claim 15, wherein the exhaust manifold further comprises an axially-elongated exhaust conduit that conveys the exhaust gas from the 180-degree bend towards the second end.

17. The outboard motor according to claim 16, wherein the thermostat is mounted on the 180-degree bend.

18. The outboard motor according to claim 13, further comprising a cooling jacket on the exhaust conduit, the cooling jacket defining a first cooling water passage that conveys cooling water in a first direction alongside the exhaust conduit, a second cooling water passage that conveys the cooling water from the first cooling water passage in an opposite, second direction alongside the exhaust conduit, and a third cooling water passage that conveys spent cooling water from the internal combustion engine to a thermostat.

19. The outboard motor according to claim 18, further comprising a first pump that pumps the cooling water through the first and second cooling water passes and a second pump that pumps the spent cooling water from the internal combustion engine to the thermostat.

20. The outboard motor according to claim 19, wherein the thermostat is movable into and between a closed position and an open position in which the spent cooling water is discharged from the third cooling water passage.

21. A cooling system for a marine engine, the cooling system comprising:

a cooling circuit that discharges spent cooling water from the marine engine;

an exhaust conduit that conveys exhaust gas from the marine engine;

a cooling jacket on the exhaust conduit, wherein the cooling jacket is configured to receive spent cooling water from the marine engine;

a thermostat configured to discharge the spent cooling water from the cooling jacket;

a pump that pumps the spent cooling water through the marine engine and into the cooling jacket on the exhaust conduit; and a second pump that pumps another flow of cooling water into the cooling jacket and alongside the exhaust conduit.

* * * * *